United States Patent [19]

Blackshaw et al.

[11] 4,409,882

[45] Oct. 18, 1983

[54] HAND GUN

[75] Inventors: Anthony C. Blackshaw, 50 McCleary Ave., Eastlea, Salisbury; Stewart M. Beecham, 24 Coltman Rd., Mt. Pleasant, Salisbury, both of Zimbabwe; Andre S. Holland, Salisbury, South Africa

[73] Assignees: Anthony C. Blackshaw; Stewart M. Beecham, both of Zimbabwe

[21] Appl. No.: 184,742

[22] Filed: Sep. 8, 1980

[30] Foreign Application Priority Data

Sep. 7, 1979 [GB] United Kingdom ..... 7931087

[51] Int. Cl.[3] ..... F41C 5/06

[52] U.S. Cl. ..... 89/163; 42/71 P; 89/137; 89/145; 89/148

[58] Field of Search ..... 42/75 C, 71 R, 71 P; 89/163, 196

[56] References Cited

U.S. PATENT DOCUMENTS

| | | | |
|---|---|---|---|
| 896,496 | 8/1908 | Whiting | 89/163 |
| 936,967 | 10/1909 | Whiting | 89/196 |
| 1,176,254 | 3/1916 | Smith | 89/196 |
| 1,365,743 | 1/1921 | Stokke | 42/71 P |
| 1,618,510 | 2/1927 | Browning | 89/163 |
| 3,492,748 | 2/1970 | Swenson | 42/70 R |
| 3,504,594 | 4/1970 | Greeley | 89/196 |
| 3,756,120 | 9/1973 | Roy | 89/163 |
| 3,850,076 | 11/1974 | Atchisson | 89/196 |
| 4,282,795 | 8/1981 | Beretta | 89/148 |

FOREIGN PATENT DOCUMENTS

| | | | |
|---|---|---|---|
| 300693 | 7/1921 | Fed. Rep. of Germany | 89/163 |

*Primary Examiner*—Stephen C. Bentley
*Attorney, Agent, or Firm*—Bacon & Thomas

[57] ABSTRACT

A recoil operated hand gun has a main frame (1) constructed from a plurality of releasably interconnected parts (2, 3, 4, 5, 6, 7), a barrel assembly (38), a slide (37) movable relative to the main frame and including a releasably secured breech block (42), a recoil spring (51), a hammer assembly (8, 11, 13, 24, 25) and trigger assembly (28, 30, 31). The barrel assembly and slide are locked together by cooperating cams (39, 7) on the barrel assembly and the main frame which force a wedge cam locking surface (55) on the barrel assembly into engagement with an opening (56) in the slide on the slide's return to its position of rest.

7 Claims, 4 Drawing Figures

HAND GUN

This invention relates to an improved hand gun.

At present a hand-gun such as a pistol has three main parts; a receiver, barrel and slide. The receiver is fitted with guides in which the slide runs. The handle of the receiver is hollow to permit insertion of a box magazine which is locked by a magazine catch. Each main part is a single unit so that if any component of that unit is faulty or damaged then the whole gun has to be replaced.

According to the present invention there is provided a hand gun comprising a main frame, and a barrel assembly, the main frame being constructed from a plurality of releasably interconnected parts. Preferably the hand gun is a mechanically locked recoil operated pistol having a slide movable relative to the main frame, the barrel assembly and slide being locked together by cooperating cams on the barrel assembly and the main frame which force the barrel assembly into engagement with the slide on return to its position of rest. The cooperating locking cams may constitute 50% of the overall inside area of the frame. It is also preferred to provide an applied ambidextrous safety catch mechanism which completely locks the hammer in the forward fixed position or the fully cocked position, whilst also locking the slide movement.

Preferably the whole pistol is constructed on a replaceable unit system: for example in the preferred arrangement the slide contains a separate breech block which, although locked to the slide, can be removed from the slide casing. Also the front bushing and recoil buffer is completely removeable and replaceable as is the hammer housing incorporating the sear and ejector.

The trigger mechanism is a removeable and replaceable unit as are trigger guard and cover plate: this is particulary useful since the trigger guard is susceptible to breakage and, if non is replaceable, the gun is unsafe and thus non-usable.

The grip profile designed for comfort and fast accurate shooting may be a one piece all steel wrap around design and for stability the slide runners preferably extend the complete length of the frame.

In the design of the preferred embodiment of pistol every effort has been made to ensure that modern methods of production can be utilized. This has therefore meant moving away from the traditional weapon design and manufacturing processes which are allied to costly investment castings and special purpose machines. The preferred pistol has been designed on unit fabrication lines utilizing high grade steel and exact tolerance pressings wherever possible.

These design features, whilst facilitating a high quality in the finished gun, also ensure that tolerances are maintained and replaceable parts available on an interchangeable basis.

This invention will now be described by way of example with reference to the accompanying drawings in which.

Figure 1:
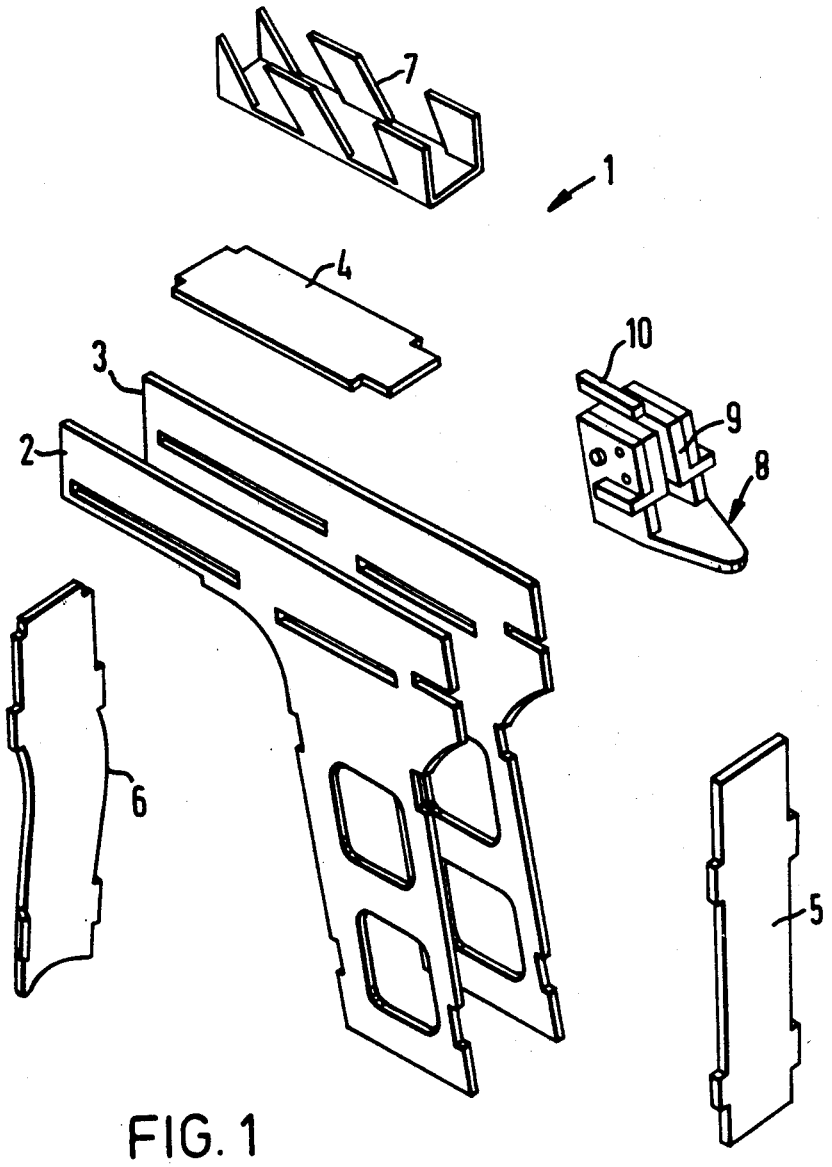
FIG. 1 is an exploded view of the frame fabrication.

In FIG. 1 a pistol has a frame 1 which, rather than being a conventional casting, is constructed from a plurality of interlocking fabricated plates namely left side plate 2, right side plate 3, floor plate 4, rear plate 5 and front plate 6. Once interlocked a locking cam plate 7 is received between the slide plates 2 and 3, and a hammer housing 8 is positioned at the rear of the frame. The hammer housing 8 includes a sear plate 9 and an ejector plate 10.

Figure 2:
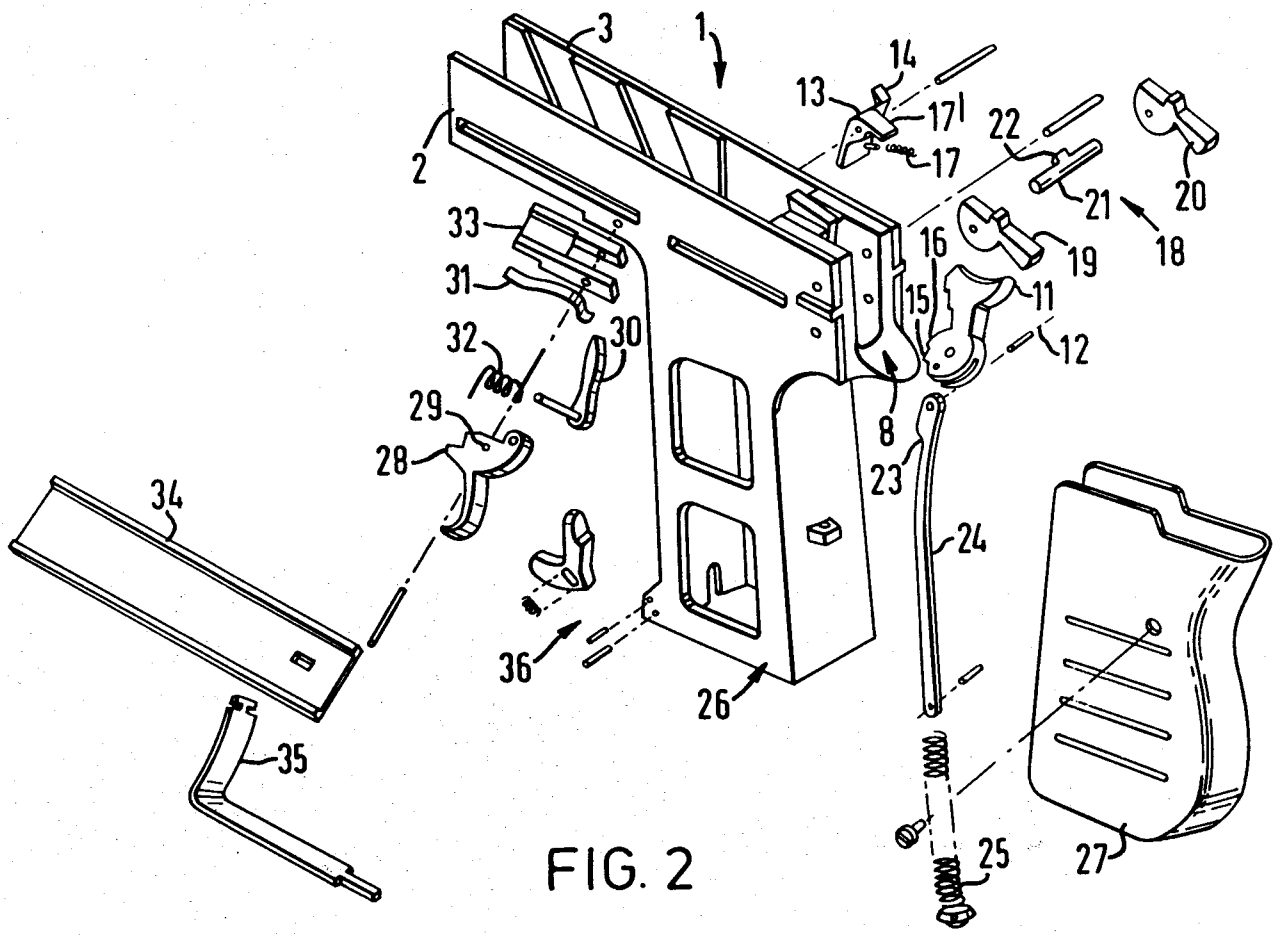
FIG. 2 is an exploded view of the parts fitting to the frame.

Referring now to FIG. 2 the hammer housing 8 receives, hammer 11 which is pivotally mount on axis 12, a rotatably mounted sear 13 having a working arm 14 engageable with full and half-cock positions 15 and 16 of the hammer a coil sear spring 17 normally biassing the sear 13 against the hammer. and a cam 17', and an ambidextrous safety catch mechanism 18. Safety catch mechanism 18 has left and right safety catches 19 and 20 on a rotatable safety lock 21 the block 22 of which is engageable with a matching cam 23 on the hammer strut 24 whether the hammer is fully forward or fully cocked. The hammer strut 24 is pivoted on the hammer 11 and is operative to load the main spring 25 on cocking of the hammer.

The handle portion 26 of the frame is covered by a removable grip 27 and in use houses a conventional magazine assembly not shown.

Forward of the handle in FIG. 2 is the trigger assembly which comprises trigger 28 pivoted at 29 and having a pawl 30. A spring trigger 31 biasses the trigger into its rest position on release and a spring 32 biasses the pawl 30. The trigger 28 is pivoted on block trigger mechanism 33 secured to the frame 1. The trigger assembly is completed by a lower frame cover plate 34 and a trigger guard 35. At the bottom of the handle 26 a spring magazine catch 36 is provided for release of the magazine for reloading.

Figure 3:
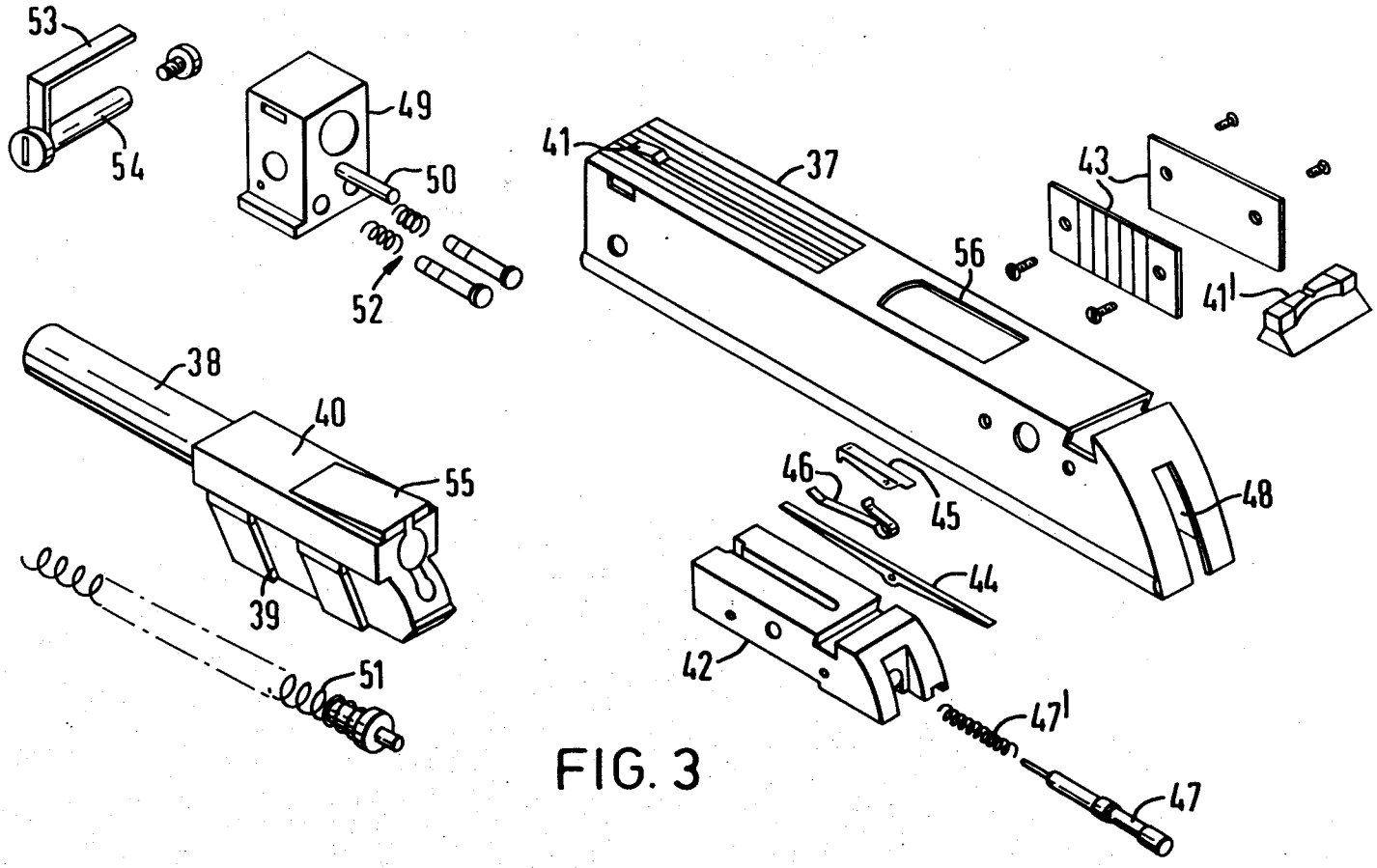
FIG. 3 is an exploded view of the slide assembly.
Figure 4:
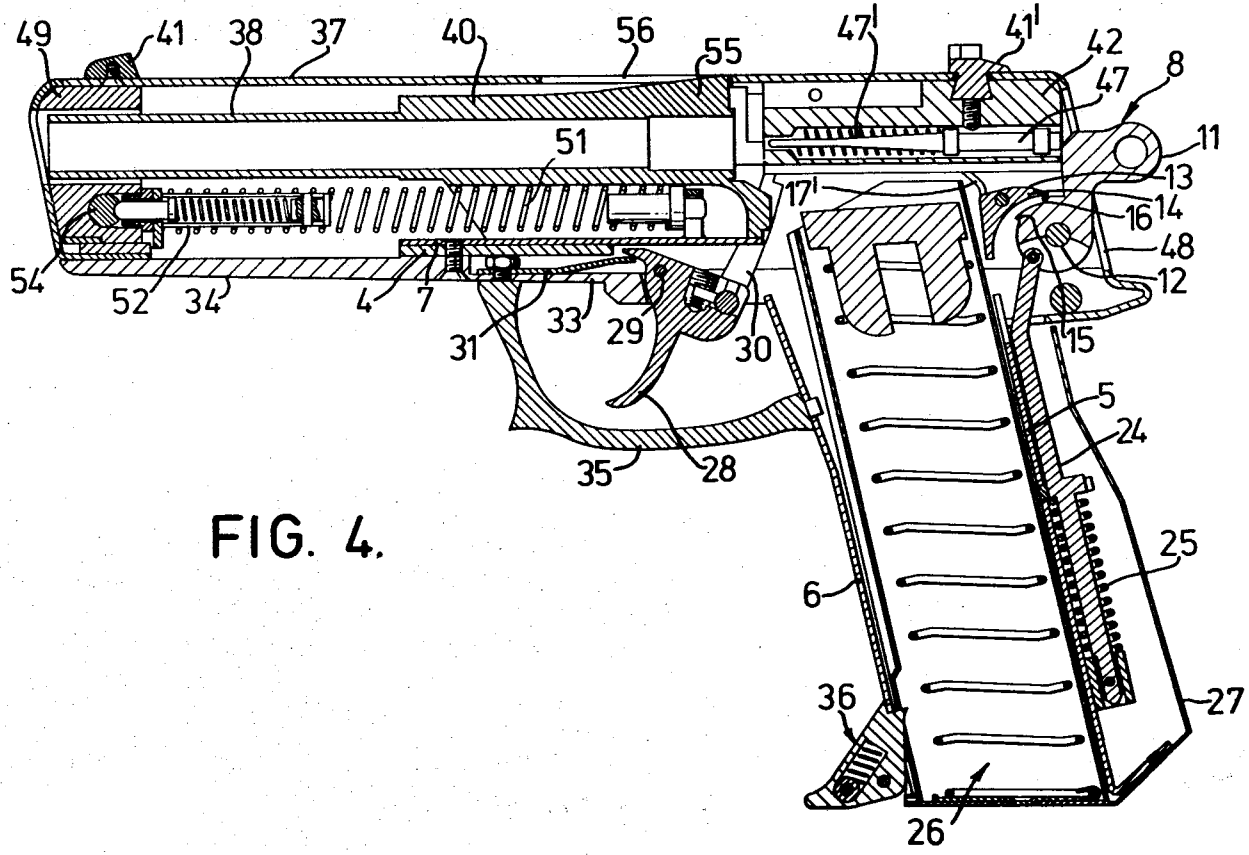

FIG. 3 illustrates the slide assembly 37 and barrel 38. The barrel 38 has cam surfaces 39 on block 40 which cooperate in the locking cam plate 7 of the frame 1. The slide 37 has a forward sight 41 and a backsight 41' and releasably receives a breech block 42 by means of side lock plates 43. The breech block 42 has pivoted there on a disconnector 44 and also includes extractor 45 and extractor spring 46. Passing through the breech block is the firing pin 47 and spring 47' of the 'flying' type ie the pin is shorter than breech to prevent unintentional firing.

The slide (37) is movable on runners on the frame formed by the floor plate 4 and hammer housing 8 and has an opening 48 for the hammer at its rear end and a front bushing block 49 at its front. Bushing block 49 supports the muzzle end of the barrel 38 and has a pin 50 for retaining a recoil spring 51. The bushing block 49 also includes buffers and springs 52 and is locked to the slide by locking bar 53 and pin locking block 54.

In order to lock the slide to the barrel assembly a wedge cam locking surface 55 on the barrel block 40 is engageable with an opening 56 in the slide 37 as will be explained more detail below.

In use, in order to load the pistol, the magazine catch 36 is pressed which ejects the magazine (not shown). Cartridges are then pressed into the magazine and the magazine reinserted into the handle of the pistol. The slide 37 is then grasped and pulled back as far as it will go, in this position the recoil spring 51 is compressed, the hammer 11 cocked loading main spring 25 and the breech block 42 has been withdrawn permitting the magazine spring (not shown) to push the top cartridge in line with the breech block. The slide is then released, the recoil spring 51 driving it forward and feeding the cartridge into barrel block 40 and the movement of the breech block 42 causing the barrel block 40 to engage with the slide due to the inclined slope of cooperating cams 39 and 7.

With a live round in the chamber and the hammer 11 fully cocked, pressure on the trigger 28 causes the trigger to rotate forcing the pawl 30 upward and causing the working face of the pawl to contact the inclined forward face of the disconnector 44.

The disconnector 44 is rotated on its axis, the rear end contacts the cam 17' of the sear 13, rotating the sear 13 and compressing its spring 17.

The working arm 14 of the sear 13 moves from its contact with the full cock position 15 of the hammer 11. The hammer 11 now released, flies forward under the influence of the compressed main spring 25 and strikes the firing pin 47. The firing pin 47 flies forward, its inertia causing it to strike the cartridge cap, and then is pulled back into the breech block 42 by its compressed coil spring 47'.

The recoil action takes place as the bullet leaves the barrel 38. The slide 37, barrel 38 and mono block 40, locked together as explained above move toward the rear, the inclined camming ramps 39 on the mono block 40 working against the inclined locking ramps 7 in the frame to force the mono block 40 and barrel 38 downward and backwards until the bottom of the mono block contacts the floor plate of the locking cams 7 and arrests it.

The slide 37 continues rearward, the extractor 45 gripping the cannelure of the spent cartridge case and pulling it from the breech holding on the face of the breech block until the face of the ejector strikes the base of the cartridge and forces it upward and out of the pistol. In its rearward movement, the slide forces the hammer 11 rearward compressing its main spring 25. It also compresses the recoil spring 51.

The rearward movement of the slide 37 is arrested by the buffers 52 on the front bushing block 49 contacting the forward area of the frame. The disconnector now free from the influence of the pawl 30 allows the sear 13 to reassert itself through the medium of the compressed sear spring 17, the working arm 14 of the sear is now ready to engage the full cock position 15 of the hammer 11 and hold it in the fully cocked position.

The compressed recoil spring now forces the slide 37 forward, the breech block 42 contacting the next cartridge in the magazine which has been pushed upwardly by the magazine spring and forces the cartridge into the breech. The breech block 42 now forces against the back face of the mono barrel block 40 forcing the mono barrel block 40 and barrel 37 forward and upward through the influence of the inclined locking ramps 39 and 7 until the top locking surface 55 of the block 40 locks into the opening 56 in the slide. The breech is thus locked and sealed.

During this forward movement the forward inclined face of the disconnector 44 strikes the rear upper surface of the pawl 30 rotating the pawl forward and compressing the pawl spring 32.

The trigger 28, which has remained pressed during this complete cycle, has now to be released before another shot can be fired.

On releasing the trigger 28 the spring trigger 31 reasserts itself rotating the trigger down on its axis, the pawl 30 being engaged to the rear of the trigger is pulled downward out of engagement with the front face of the disconnector 44.

The spring pawl 32 now reasserts itself forcing the pawl 30 rearward, ready to engage the disconnector 44 when the trigger 28 is next pressed.

As a safety feature the trigger 28 is rendered inoperative when the magazine is removed. This is achieved by the overall rearward movement of the pawls' rotation through the medium of its spring being determined by the front face of the magazine. When the magazine is removed the pawl 30 is able to rotate well to the rear into an inoperative position.

As explained above the applied safety is ambidextrous with a solid cam block locking onto a matching cam on the hammer strut, the left and right safety catches 19 and 20 have protrusions which engage in the recesses in the slide 37 when the catches are in the safe position.

The preferred form of pistol illustrated has the following specifications:

CALIBRE: 9 mm Parabellum
SYSTEM OF OPERATION: Recoil semi-automatic
BARREL LENGTH: 120 mm
WEIGHT: 36 ounzes
OVERALL LENGTH: 202 mm
MAGAZINE: Box type 15 round capacity
SIGHTS: Large Blade F/Sight-Adjustable 'U' B/Sight
MUZZLE VELOCITY: 1040 to 1500 F.P.S. dependant on ammunition

We claim:

1. A recoil operated hand gun comprising a main frame constructed from a plurality of interconnected fabricated plates and having left and right-hand side plates interconnected by a bottom plate defining a longitudinal recess; a barrel assembly supported on the main frame and received in said longitudinal recess; a slide movable relative to the main frame and co-operating with said left and right-hand side plates to enclose the barrel assembly within said longitudinal recess, the barrel assembly and slide being locked together by co-operating cam means on the barrel assembly and on the main frame which force the barrel assembly into engagement with the slide on return to its position of rest, the co-operating cam means comprising inclined complementary tongue and grooves on the main frame and the barrel assembly, the cam means on the main frame comprising a separate pressed cam plate received between the left and right-hand side plates.

2. A hand gun according to claim 1 characterized in than the slide (37) is a pressed plate and includes a machined breech block (42) releasably fastened to the slide, said slide and breech block forming a prefabricated sub-assembly removable from said main frame.

3. A hand gun according to claim 1 characterized in that the barrel assembly (38) is engageable with the slide (37) by means of a wedge cam locking surface (55) on the barrel assembly which is engageable with an opening (56) in the slide, said opening also providing an outlet for the ejection of spent cartridge cases.

4. A recoil operated hand gun according to claim 1 wherein the slide is movable on runners on the main frame which extend along the frame and are formed by lateral extensions of the bottom plate of the main frame and of the hammer housing.

5. A recoil operated hand gun comprising a main frame, a barrel assembly, a slide movable relative to the main frame, a recoil spring biasing the slide to an outer position, a breech block connected to the slide, a firing pin received by the breech block, a hammer assembly and a trigger assembly wherein: the main frame is constructed from a plurality of interconnected fabricated plates, namely a left-side plate having a longitudinal portion and a depending portion, a right-side plate having a longitudinal portion and a depending portion, a bottom plate, a rear plate and a front plate, the bottom plate defining with the longitudinal portions of the left and right-side plates a longitudinal recess in which the barrel assembly is received, and the rear plate and front plate co-operating with the depending portion of the side plates to define a downwardly depending grip portion; the barrel assembly and the slide are locked together by cooperating cams on the barrel assembly and the main frame which force the barrel assembly into engagement with the slide on return to its position of rest; the hammer assembly, wherein a hammer has full and half-cock rotatably mounted seat having a working arm engageable with the full and half cock positions, and a spring biasing the seat against the hammer; an applied ambidextrous safety catch mechanism mounted on the main frame comprising left and right safety catches; and runners, located on the main frame, upon which the slide is movable, said runners extending along the main frame and formed by lateral extensions of the bottom plate of the main frame and the hammer housing.

6. A recoil operated hand gun according to claim 5 characterised in that, the main frame includes a hammer housing (8) releasably secured to the main frame, the breech block (42) is releasably secured to the slide (37), a front barrel bushing (49) is releasably secured to the slide, and the trigger assembly includes a replaceable trigger guard (35) whereby individual units of the hand gun may be replaced as required.

7. A recoil operated hand gun according to claim 5 including an extractor assembly characterised in that the cooperating cams are complimentary inclined ramps on the barrel assembly and the main frame, the recoil action as a bullet leaves the barrel assembly comprising first rearward movement of the slide and barrel assembly together, the cooperating inclined camming ramps on the barrel assembly and the main frame guiding the barrel assembly downwardly so as to disengage from the slide, and second continued rearward movement of the slide alone until the hammer assembly is cocked for a subsequent firing cycle, the rearward movement of the side compressing the recoil spring, releasing the extractor assembly for ejecting the spent cartridge from the face of breech block, and permitting the loading of a further cartridge forward of the breech block, the recoil spring, at the end of said rearward movement forcing the slide and barrel assembly back into an engaged position ready for subsequent firing.

* * * * *